United States Patent [19]

Thomas

[11] Patent Number: 4,778,157

[45] Date of Patent: Oct. 18, 1988

[54] SPRING MODULE

[75] Inventor: Kenneth H. Thomas, Oxford, Mass.

[73] Assignee: Webster Spring Co. Inc., Oxford, Mass.

[21] Appl. No.: 66,096

[22] Filed: Jun. 25, 1987

[51] Int. Cl.[4] ..... A47C 23/02

[52] U.S. Cl. ..... 267/103; 5/247; 267/106; 267/108; 267/144

[58] Field of Search ..... 267/103, 104, 105, 106, 267/107, 108, 109, 144, 167; 5/247, 255, 267, 272, 273, 276, 274, 260, 476

[56] References Cited

U.S. PATENT DOCUMENTS

| | | | |
|---|---|---|---|
| 634,313 | 10/1899 | Teeter et al. | 5/247 |
| 946,125 | 1/1910 | Hachman | 267/106 |
| 1,528,125 | 3/1925 | Morse | 5/247 |
| 3,945,627 | 3/1976 | Simon | 267/108 |
| 4,577,841 | 3/1986 | Hagemeister | 267/103 |

FOREIGN PATENT DOCUMENTS

| | | | |
|---|---|---|---|
| 673637 | 10/1929 | France | 267/109 |

*Primary Examiner*—Douglas C. Butler
*Assistant Examiner*—Matthew C. Graham
*Attorney, Agent, or Firm*—Robert T. Gammons

[57] ABSTRACT

A spring module for disposition between a base frame and a grid frame of a spring assembly embodying upper and lower attaching elements for attachment to, respectively, the grid frame and the base frame and spaced, parallel, vertically-disposed, yieldable legs, each leg embodying a vertically-disposed loop of wire and upwardly and downwardly, oppositely-inclined, V-shaped lengths of wire extending from the loop to, respectively, the upper and lower attaching elements.

6 Claims, 1 Drawing Sheet

SPRING MODULE

BACKGROUND OF THE INVENTION

Spring assemblies customarily comprise a base frame, a grid frame and a plurality of spring modules disposed between and attached to the base frame and grid frame. Generally, the spring module is either the coil spring type or the bent wire spring type. Sometimes the two types are embodied in a single spring assembly, thereby obtaining the characteristic advantages of both types of spring. It is the purpose of this invention to provide a single spring module which will embody the characteristics of both types of modules for use in spring assemblies, thus simplifying assembling operations.

SUMMARY OF THE INVENTION

In accordance with this invention, the spring module as herein illustrated comprises upper and lower attaching elements for attachment to a grid frame and a base frame, the module comprising vertically-disposed, spaced, parallel legs connected at their upper ends to upper attaching elements and at their lower ends to lower attaching elements, each leg comprising substantially midway between the upper and lower attaching elements, a loop of wire disposed in a generally vertical plane from which extend upwardly and downwardly-inclined straight lengths of wire which are, respectively, connected to the upper and lower attaching elements and wherein the loops are offset relative to each other and wherein the downwardly and upwardly-inclined lengths of wire of the respective legs are inclined in opposite directions. The upwardly and downwardly-inclined straight lengths of wire diverge with respect to each other and the loops of wire are disposed between the diverging lengths of wire. The upper and lower attaching elements comprise spaced, parallel, generally-horizontal lengths of wire disposed at right angles to the vertical planes of the legs and diagonal lengths of wire in the plane of the parallel lengths of wire. The diagonal lengths of wire of the upper and lower attaching elements are disposed in opposite directions.

The invention will now be described in greater detail with reference to the accompanying drawings, wherein.

Figure 5:
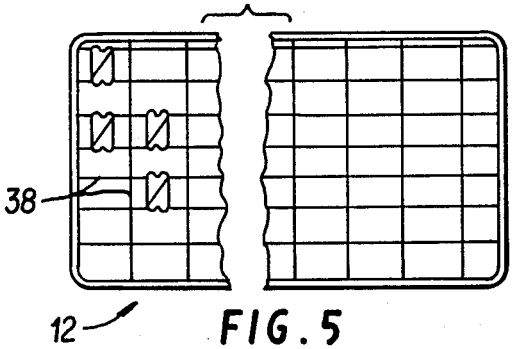
FIG. 5 is a plan view of the grid frame to which the upper ends of the spring modules are attached.
Figure 6:
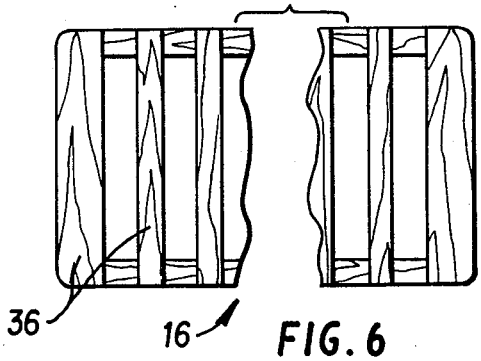
FIG. 6 is a plan view of the base frame to which the lower ends of the spring modules are attached.

Referring to the drawings, FIGS. 10 an 14, the spring module as herein illustrated comprises an upper attaching element 10 for attachment to a grid frame 12 such as shown in FIG. 5, a lower attaching element 14 for attachment to a base frame 16 such as shown in FIG. 6 and vertically-disposed, spaced, parallel legs 18—18 disposed between and connected to, respectively, the upper and lower attaching elements 10 and 14.

Figure 1:
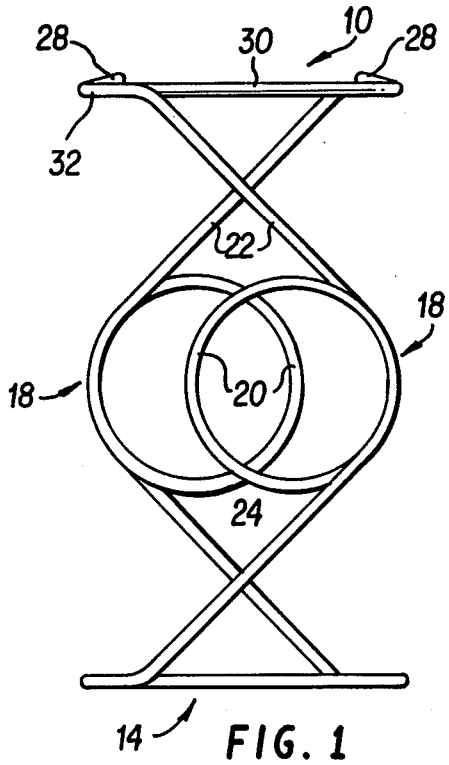
FIG. 1 is an elevation of the spring module constructed according to this invention as seen from one side.
Figure 2:
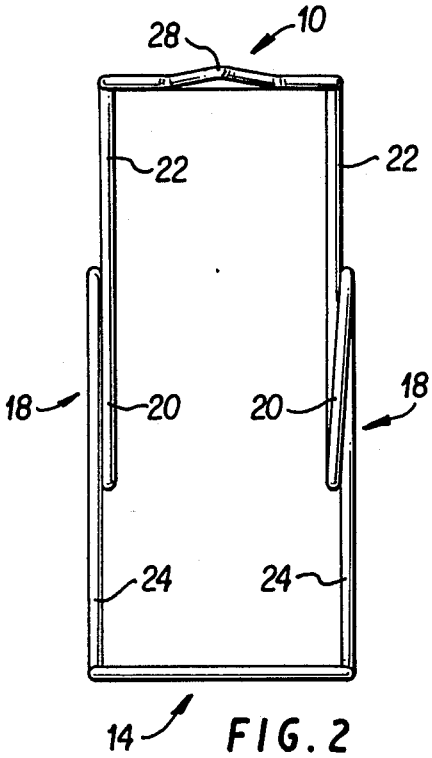
FIG. 2 is an elevation of the spring module of FIG. 1 taken at right angles to that shown in FIG. 1.
Figure 3:
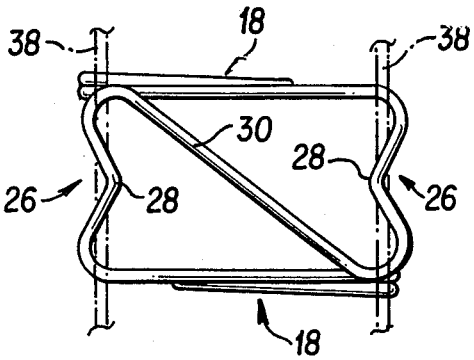
FIG. 3 is a plan view of the upper end of the spring module.
Figure 4:
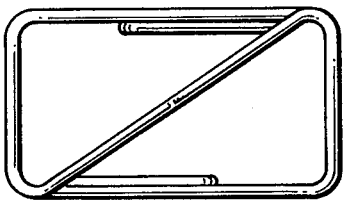
FIG. 4 is a plan view of the lower end of the spring module.

In accordance with this invention, each leg 18 comprises a loop 20 of circular configuration from which extend in diverging relation to each other straight lengths of wire 22 and 24. The lengths of wire 22—22 are connected to the upper attaching element 10 and the lengths of wire 24—24 are connected to the lower attaching element 14. The loops 20—20 of the respective legs are disposed in spaced, parallel, vertical planes and are displaced relative to each other, FIG. 1. The upper lengths of wire 22—22 and the lower lengths of wire 24—24 in the respective legs are inclined in opposite directions.

The upper attaching elements 10 comprise spaced, parallel lengths of wire 26—26 disposed in parallel relation to each other and at right angles to the planes of the legs. The parallel lengths of wire 26—26 contain deviations 28—28. The parallel lengths of wire 26—26 are connected at their opposite ends by a diagonal length of wire 30. The lower attaching elements 14 comprise spaced, parallel lengths of wire 32—32 disposed in parallel relation to each other and at right angles to the planes of the legs and these are connected by a diagonal 34.

The diagonals 30,34 of the upper and lower attaching elements are disposed in the same direction with respect to each other.

As illustrated, the upper ends of the inclined lengths of wire are connected to the upper attaching elements 10 by short, horizontally-disposed lengths of wire 32—32 disposed in the plane containing the parallel and diagonal lengths of wire 26—26 and 30.

The modules as thus described are disposed between the grid frame 12 and the base frame 16 with their lower ends resting on the transverse bars 36 of the base frame and their upper ends abutting the grid wires 38 of the grid frame. The lower ends of the modules are attached to the bars 36 by means of staples 40 and the upper ends by interengagement of the deviations 28—28 with the longitudinal wires 38 of the grid frame.

It should be understood that the present disclosure is for the purpose of illustration only and includes all modifications or improvements which fall within the scope of the appended claims.

What is claimed is:

1. A spring module comprising upper and lower attaching elements for attachment to a grid frame and a base frame, said module comprising vertically-disposed, spaced, parallel legs connected at their upper ends to the upper attaching element and at their lower ends to the lower attaching element, each leg comprising substantially midway between the upper and lower attaching elements a loop of wire disposed in a generally vertical plane from which extend upwardly and downwardly-inclined straight lengths of wire which are, respectively, connected to the upper and lower attaching elements and wherein the loops are situated in spaced, parallel, vertical planes in overlapping relation to each other such that the adjacent sides of the coils pass through the centers of the respective loops and the upwardly and downwardly-inclined lengths of wire of the respective legs are inclined in opposite directions.

2. A spring module according to claim 1 wherein the upwardly and downwardly-inclined straight lengths of wire diverge with respect to each other and the loops of wire are disposed between the diverging lengths of wire.

3. A spring module according to claim 1 wherein the loops of wire are circular.

4. A spring module according to claim 1 wherein the upper and lower attaching elements comprise spaced, parallel, generally horizontal lengths of wire disposed at right angles to the vertical planes of the legs and diagonal lengths of wire in the plane of the parallel lengths of wire.

5. A spring module according to claim 4 wherein the diagonal lengths of wire of the upper and lower attaching elements are disposed in opposite directions.

6. A spring module according to claim 4 wherein the spaced, parallel lengths of wire contain deviations.

* * * * *